US007806729B2

(12) United States Patent
Nguyen et al.

(10) Patent No.: US 7,806,729 B2
(45) Date of Patent: Oct. 5, 2010

(54) HIGH-SPEED BACKPLANE CONNECTOR

(75) Inventors: Hung Thai Nguyen, Harrisburg, PA (US); John A. Fulponi, Harrisburg, PA (US); Brent David Yohn, Newport, PA (US)

(73) Assignee: Tyco Electronics Corporation, Middletown, PA (US)

( * ) Notice: Subject to any disclaimer, the term of this patent is extended or adjusted under 35 U.S.C. 154(b) by 241 days.

(21) Appl. No.: 12/029,540

(22) Filed: Feb. 12, 2008

(65) Prior Publication Data

US 2009/0203259 A1 Aug. 13, 2009

(51) Int. Cl.
*H01R 13/648* (2006.01)

(52) U.S. Cl. ..... 439/607.23

(58) Field of Classification Search ..... 439/608, 439/607

See application file for complete search history.

(56) References Cited

U.S. PATENT DOCUMENTS

2002/0123266 A1 9/2002 Ramey
2003/0143894 A1 7/2003 Kline
2005/0245105 A1 11/2005 Driscoll

FOREIGN PATENT DOCUMENTS

WO WO 01/57964 8/2001

OTHER PUBLICATIONS

International Search Report, International Application No. PCT/US2009/000818, International Filing Date, Oct. 2, 2009.

*Primary Examiner*—Briggitte R Hammond

(57) ABSTRACT

A terminal module for assembly into a high-speed electrical connector having a contact receiving first contact pair and second contact pair, the second contact pair being in electrical communication with the first contact pair via a corresponding pair of contact interconnections. The contact interconnections have a substantially identical length of the corresponding pair and are arranged within parallel planes. The module further includes a shielding member arranged and disposed in close proximity to at least three edges of one or more of the first contact pair, the second contact pair and the contact interconnections to provide shielding. A housing member is arranged and disposed to receive backplane contacts via contact receiving apertures. The housing member is engaged with the first contact pair to receive the contacts into the contacts of the first contact pair. A backplane having grounding plate grid is also disclosed.

20 Claims, 15 Drawing Sheets

HIGH-SPEED BACKPLANE CONNECTOR

FIELD OF THE INVENTION

The present disclosure is directed to electrical connectors. In particular, the disclosure is directed to high-speed electrical connectors for connecting circuit boards.

BACKGROUND OF THE INVENTION

Electronic equipment, such as that used in military applications, is often required to be operated in rugged, extreme environmental conditions. Examples of such conditions include excessive moisture, salt, heat, vibration, mechanical shock, and electromagnetic interference (EMI). To function cooperatively, some type of connector is required so that when two printed circuit boards are brought into electrical contact with one another, the boards function as a single board when inserted into a backplane board or other module of a larger electronic piece of equipment.

Other conventional connectors include a two-piece connector using so-called flex circuits extending from the printed circuit boards. These flex circuits must be soldered to the printed circuit board. While the flex circuits may provide easier access for the soldering, problems with alignment still exist. In addition, the flex circuit has long tails that act like antennae, which tails create interference and limit performance as described above. In addition other conventional connectors provide little or no shielding from adjacent wires, resulting in cross talk and decreased data transfer speed.

What is needed is a way to terminate a printed circuit board or other circuit for connecting to a backplane board that avoids problems in mismatched impedance, alignment, cross talk and maintains a high-speed electrical signal connection between printed circuit boards in rugged, extreme environmental conditions.

SUMMARY OF THE INVENTION

A first aspect of the present invention includes a terminal module for assembly into a high-speed electrical connector having a contact receiving a first contact pair and second contact pair, the second contact pair being in electrical communication with the first contact pair via a corresponding pair of contact interconnections. The contact interconnections have a substantially identical length of the corresponding pair and are arranged within parallel planes. The module further includes a shielding member arranged and disposed in close proximity to at least three edges of one or more of the first contact pair, the second contact pair and the contact interconnections to provide shielding.

A second aspect of the present invention includes an extremely low noise, high-density impedance control backplane assembly for a high-speed electrical connector. The assembly includes a first grounding plate and a second grounding plate disposed at a substantially perpendicular angle to the first grounding plate to form a grid arrangement forming a plurality of cells. Each cell is configured to receive a contact pair. An electrically insulative body is in contact with at least a portion of the first grounding plate and the second grounding plate. In addition, one or both of the first grounding plate and the second grounding plate comprises a ground plate contact arranged and disposed to electrically connect to a circuit board, in such connection there is no crosstalk between signal contact pair that's providing high signal integrity which is necessary for high speed signal applications.

A third aspect of the present invention includes a high-speed electrical connector comprising a terminal module for assembly into the high-speed electrical connector having a first contact pair and second contact pair capable of receiving a contact, the second contact pair being in electrical communication with the first contact pair via a corresponding pair of contact interconnections. The contact interconnections have a substantially identical length of the corresponding pair and are arranged within parallel planes. The module further includes a shielding member arranged and disposed in close proximity to at least three edges of one or more of the first contact pair, the second contact pair and the contact interconnections to provide shielding. A housing member is arranged and disposed to receive the contacts via contact receiving apertures. The housing member is engaged with the first contact pair to receive the contacts into the contacts of the first contact pair. The connector system further comprises a backplane assembly engaged with the housing member and module. The backplane assembly includes a first grounding plate and a second grounding plate disposed at a substantially perpendicular angle to the first grounding plate to form a grid arrangement forming a plurality of cells. Each cell is configured to receive a pair of the contacts. An electrically insulative body is in contact with at least a portion of the first grounding plate and the second grounding plate. At least one of the first grounding plate and the second grounding plate includes an opening configured to permit flow of electrically insulative material during formation of the insulative body. In addition, one or both of the first grounding plate and the second grounding plate comprises a contact arranged and disposed to electrically connect to a circuit board.

An advantage of the present disclosure is that the contact pairs are shielded electrically and mechanically to provide the ability to operate at high-speed with protection against electromagnetic interference and physical damage to the contact pairs.

Another advantage is that grounding may be achieved with fewer connections to the circuit boards, providing additional space for additional pairs and/or wiring.

Another advantage is that the mesh contact member provides alignment and signal continuity between printed circuit boards, particularly when exposed to rugged and/or extreme environmental conditions.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers are used throughout the drawings to refer to the same or like parts.

DETAILED DESCRIPTION OF THE INVENTION

Figure 1:
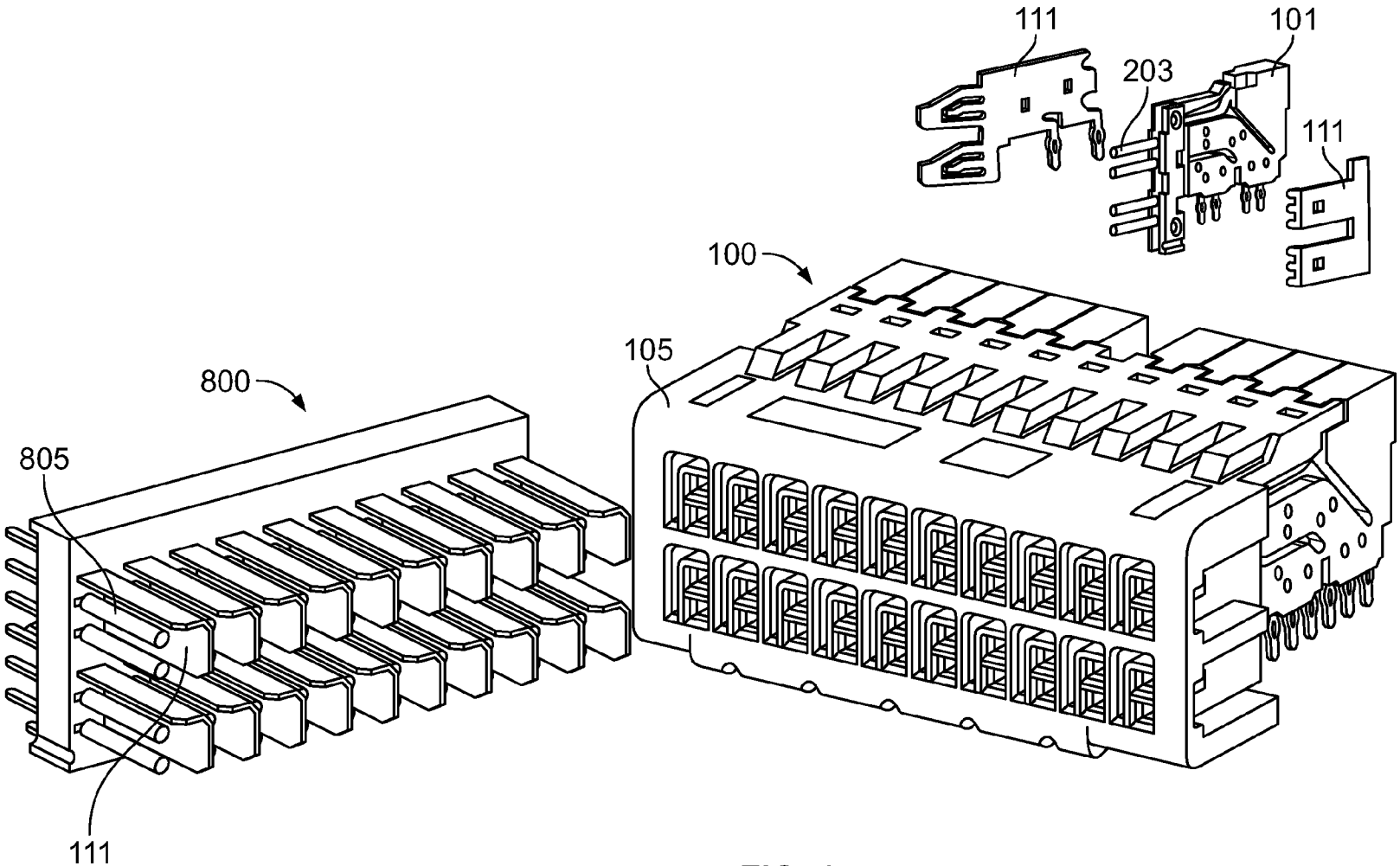
FIG. 1 (Prior Art)
FIG. 1 shows a perspective view of a known connector system.

FIG. 1 shows a partially exploded view of a known connector system 100 and backplane 800. As shown, the connector system 100 includes the terminal modules 101 arranged within the terminal housing 105, as shown and described above with respect to FIG. 1. In addition, in this embodiment, cross-talk shielding members 111 are provided and disposed between adjacent modules 101 to resist or prevent cross-talk between modules 101. The cross-talk shielding members 111 upon engagement between the connector system 100 and the backplane 800 may be utilized to shield the signal contacts from signals within adjacent modules 101 and may include any structures known in the art for providing electrical shielding. Housing module 105 includes a plurality of socket receiving apertures 107 configured to receive sockets of a backplane 800. The terminal modules 101 connect to the PCB 103 via first contact portion 201 engaged with opening 109 in the PCB 103. The terminal modules 101 include second contact portions 203 for connecting to a backplane 800. The shielding members 111 shown in FIG. 1 are configured and disposed adjacent terminal modules 101 to provide shielding for corresponding contact portions. Shielding members 111 may be utilized to shield the signal contacts from EMI/RFI and include "L" shaped shields that are insertable into corresponding shielding openings in housing module 105 to provide the shielding. The shielding members 111 do not provide complete shielding of the contact portions 203 and require additional spacing between adjacent contact portion 203 pairs. In addition, the interconnection of the shielding members 111 requires insertion force in additional to the insertion force required to engage connector contact 203 to backplane contact 805.

Figure 2:
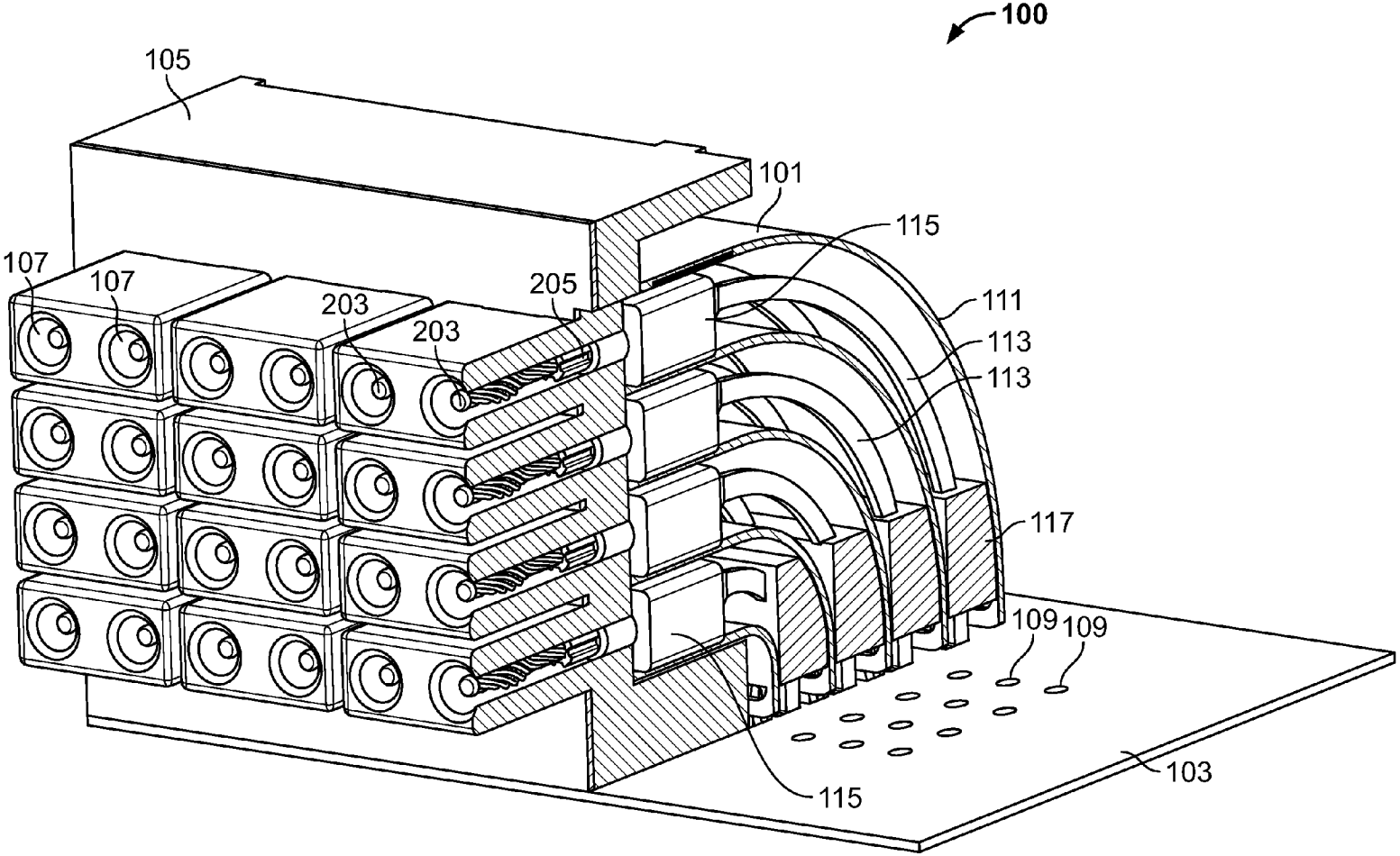
FIG. 2 shows a perspective view of a connector system according to an embodiment of the disclosure.

FIG. 2 shows a connector system 100 according to an embodiment of the disclosure including a plurality of terminal modules 101 connected to a printed circuit board (PCB) 103 and inserted into a terminal housing member 105. The PCB 103 is not limited to a printed circuit board 103 and may include any circuit arrangement requiring connection to another circuit. Housing member 105 includes a plurality of contact receiving apertures 107 configured to receive contacts of a backplane 800 (see e.g., FIG. 13). The backplane 800 is preferably disposed on a circuit, such as a printed circuit board, (not shown) to be electrically interconnected with the PCB 103. The terminal modules 101 connect to the PCB 103 via first contact pair 201 (see e.g., FIG. 3) engaged with opening 109 in the PCB 103. The terminal modules 101 include second contact pair 203 (see also e.g., FIG. 3) for connecting to a backplane 800 (see e.g., FIG. 13). Although the first contact pair 201 and the second contact pair 203 are described as a "pair", the term "pair" is not limited to two electrically conductive wires, but may include any number of wires or wire that provide the functionality of the first contact pair 201 and the second contact pair 203 during operation, such operation including, but not limited to carrying signals or power between circuit boards. Shielding members 111 are mounted to terminal modules 101 to provide shielding for contact interconnection 113. The shielding member 111 is arranged into an S-shaped geometry profile such that the shielding member passes along three edges in close proximity to the contact interconnections 113 (see enlarged view in FIG. 3). The shielding members 111 are further configured such that adjacent shielding members 111 on terminal modules 101 enclose adjacent contact interconnections 113 in close proximity to four sides. Shielding members 111 or similar structures may be utilized to shield the signal contacts from EMI/RFI and may be fabricated from any electrically conductive material known in the art for providing electrical shielding. Suitable materials for formation of the shielding members 111 include, but are not limited to, plated metal (e.g., brass, phosphor bronze), molded plastic having an electrically conductive plating or vacuum formed plastic having an electrically conductive plating. The contact interconnection 113 is connected to the second contact pair 203 by a connection portion 115. The connection portion 115 is configured to provide electrical connection between the second contact pair 203 and the contact interconnection 113. The contact interconnection 113 is connected to the first contact pair 201 by a spacer 117. The spacer 117 may be an insulating material disposed over a unitary component forming the first contact pair 201 and the contact interconnection 113 or may be a connection between the first contact pair 201 and the contact interconnection. Connections within the connection portion 115 and the spacer 117 may be made by formation of unitary components or may be connected by soldered or non-soldered connections, such as crimping or otherwise mechanically engaging electrically conductive materials.

Figure 3:
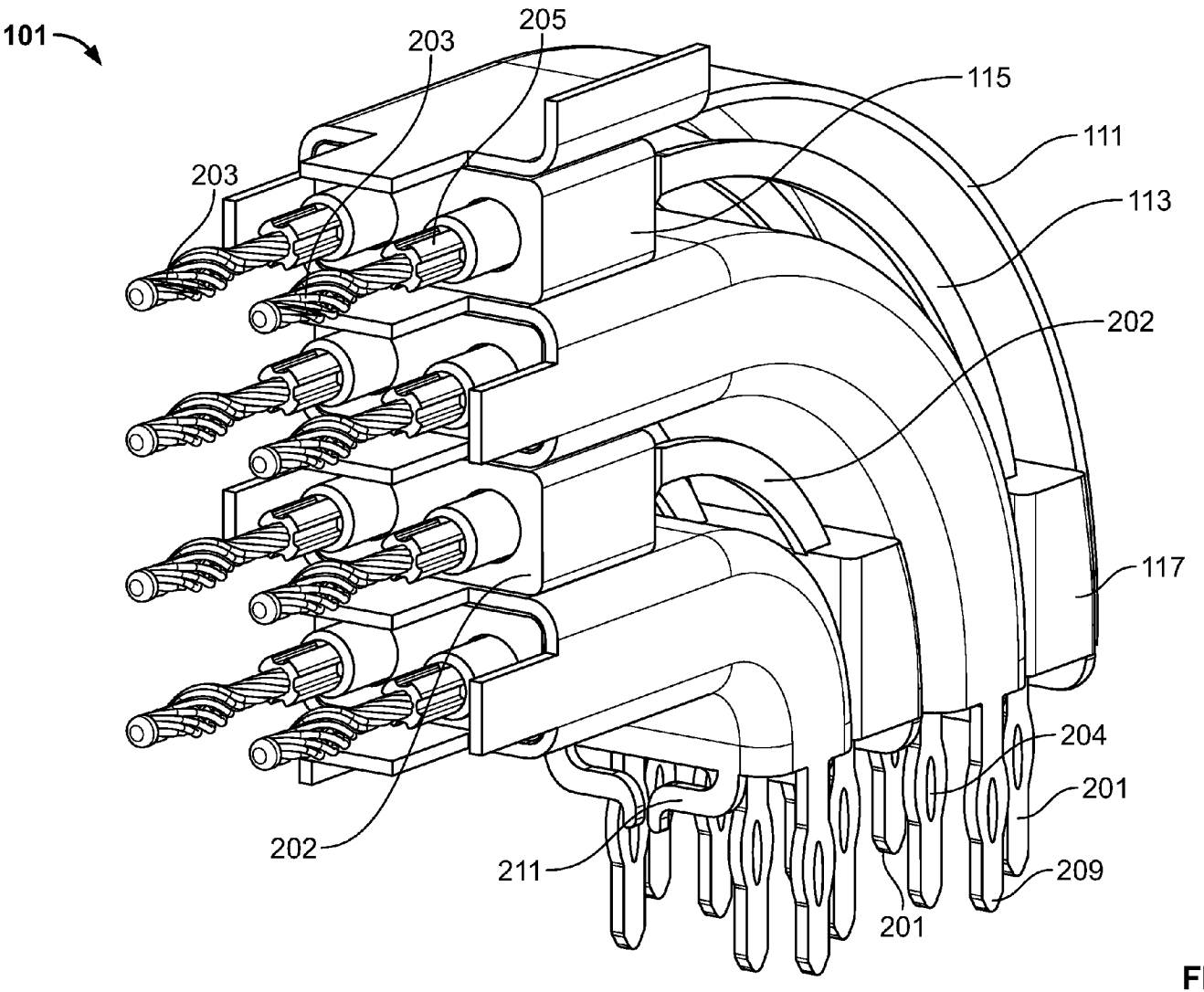
FIG. 3 shows a perspective elevation view of a terminal module according to an embodiment of the disclosure.

FIG. 3 shows a perspective view of a terminal module 101 according to an embodiment of the disclosure. The terminal module 101 includes a plurality of first contact pairs 201 and a plurality of second contact pairs 203. The first contact pair 201 and second contact pair 203 are electrically connected via a contact interconnection 113. The first contact pair 201, the second contact pair 203 and the interconnection between corresponding first contact pair 201 and second contact pair 203 forms the interconnection assembly 202. While FIG. 3 shows four interconnection assemblies 202, the invention is not so limited and may include any number of interconnection assemblies 202, including greater than four or less than four. In one embodiment, the first contact pair 201 and the second contact pair 203 are perpendicularly disposed. The contact interconnections 113 are partially disposed within shielding member 111. As discussed above with respect to FIG. 2, the shielding member 111 is configured to surround, in close proximity, at least three edges of the contact interconnections 113. The shielding member 111 is preferably electrically grounded. The shielding member 111 may be grounded by electrically communicating with a corresponding ground on one or both of the circuit boards being connected. The shielding member 111 may also be electrically connected to another source for ground. The shielding member 111 may include grounding contacts 209, which engage and electrically communicate with PCB 103. Further, shielding member 111 may include grounding fingers 211 (see e.g., FIG. 4), which contact and electrically communicate with PCB 103. While the shielding member 111, the grounding contacts 209 and the grounding fingers 211 may be a unitary component, each of the components may also be separate components assembled together to provide the shielding of the interconnection assemblies 202. Shielding members 111 are provided and disposed between adjacent modules 101 and between pairs of contact interconnections 113 to resist or prevent cross talk between modules 101. The shielding members 111 for shielding may be utilized to shield the signal contacts from signals within a single module 101 and adjacent modules 101 and may include any structures known in the art for providing electrical shielding.

Spacer 117 provides insulation, placement and spacing of the contact interconnections 113, first contact pairs 201 and modules 101 within the connector system 100. The first contact pair 201 is configured to connect with openings 109 formed in PCB 103. Suitable configurations for the first contact pairs 201 include, but are not limited to, compliant contacts 204 that engage openings 109 and provide electrical connectivity. The connection portion 115 also includes a dielectric or insulative portion disposed over the connection between the second contact pair 203 and the contact interconnections 113. Alternatively, the spacer 117 and the connection portion 115 may be a unitary component. The distance between the contact interconnections 113 is maintained in order to provide the desired impedance between the contact interconnections 113. The contact interconnections 113 within the interconnection assembly 202 are preferably disposed within parallel planes, separated by a predetermined distance. The distance will vary and depend upon the impedance desired for the contact interconnections 113. The connection portions 115, like the spacer 117, provides insulation, placement and spacing of the contact interconnections 113, second contact pairs 203 and modules 101 within the connector system 100. The second contact pair 203 includes a connector contact 205, where the connector contact 205 is configured as hollow cylinders or similar geometry capable of receiving and electrically communicating with a contact or other elongated connection device. Although the above has been described with respect to cylindrical connector contacts 205, the connector contacts 205 may include alternate annular geometries, including but not limited to annular conduits having an oval, square, rectangular or other cross-section configured to receive backplane contacts 805 (see e.g., FIG. 8) and engage and electrically communicate with contacts 805 along the periphery of the interior of the connector contact 205. While the connections at the first contact pair 201 and second contact pairs 203 are shown as sockets and pins, the first contact pair 201 and second contact pairs 203 may be any type of contact having any mating geometry capable of providing electrical communication therebetween. Other contact configuration suitable for first contact pairs 201 and second contact pairs 203 include mesh contact members, bristles, compliant contacts, non-compliant contacts and combinations thereof. In addition, configurations suitable for first contact pairs 201 and second contact pairs 203 include sockets configured to receive mesh contact members, bristles, compliant contacts, non-compliant contacts and combinations thereof. Further, the geometry of the first contact pair 201 and/or second contact pairs 203 is not limited to a socket or pin. For example, the connector contacts 205 may include pin-like geometries or similar structures extending from the connection portion 115.

The first contact pairs 201, the second contact pairs 203 and the contact interconnections 205 may be formed in part or in whole of an electrically conductive material or coating in part or in whole with an electrically conductive material so as to provide an electrical connection to the PCB 103 and the backplane 800. For example, the electrically conductive components may be formed of a phosphor bronze metal with tin plating or other known industry acceptable conductive metal and/or plating combinations.

Figure 4:
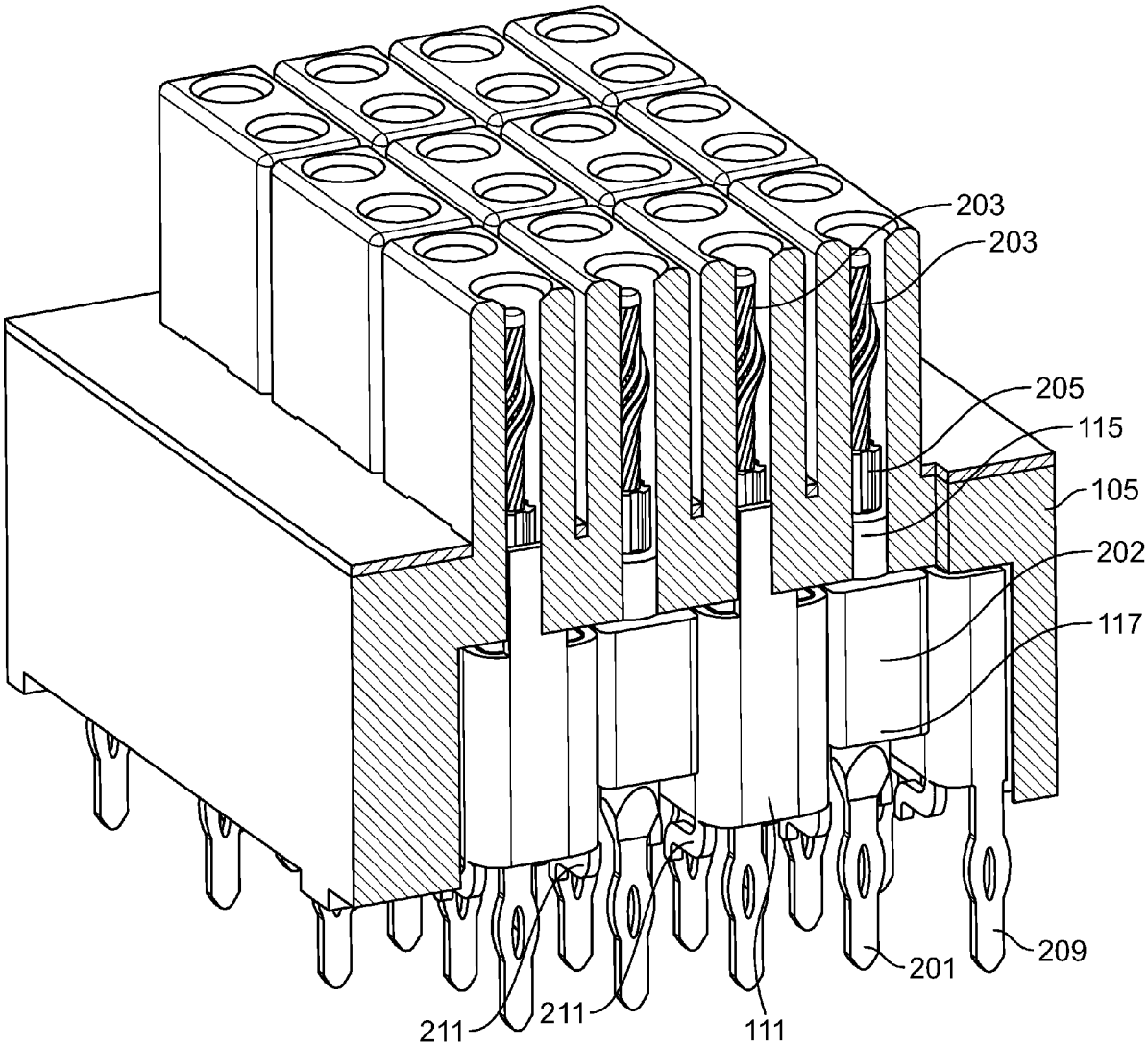
FIG. 4 shows a sectional view of a terminal module according to another embodiment of the disclosure.

FIG. 4 shows an alternate embodiment of a terminal module 101 according to another embodiment of the disclosure. The terminal module 101 includes the components of FIG. 3, wherein the interconnection assemblies 202 are arranged in a linear configuration. That is, the first contact pair 201 and second contact pair 203 are arranged substantially along a single axis. As discussed above with respect to FIG. 3, the shielding members 111 are arranged in an "S"-shaped geometry. The shielding member 111 includes grounding contacts 209 which engage and electrically communicate with PCB 103. Shielding member 111 further includes grounding fingers 211 that contact and electrically communicate with PCB 103.

Figure 5:
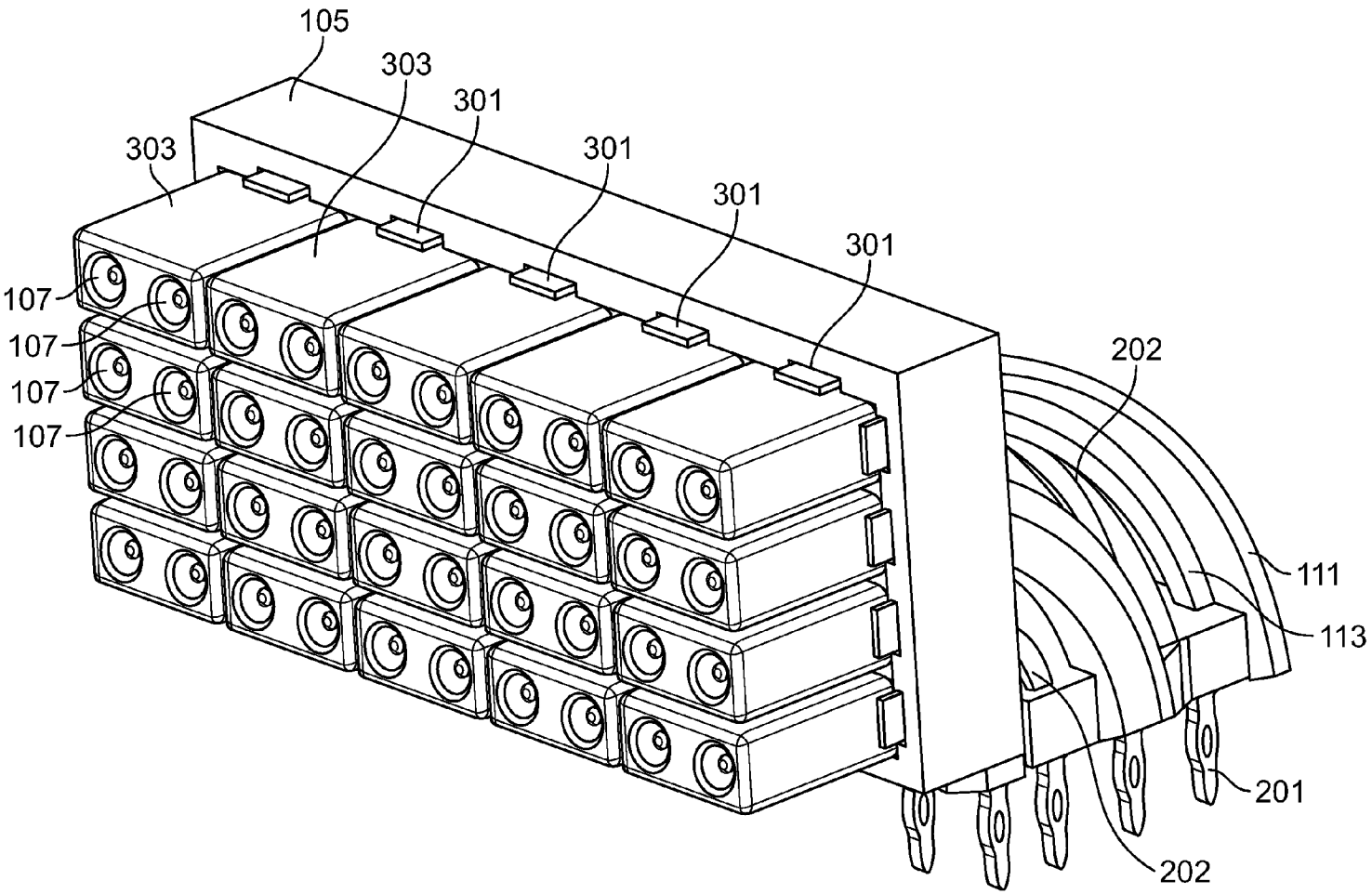
FIG. 5 shows a perspective view of a terminal module having a housing member according to an embodiment of the disclosure.
Figure 6:
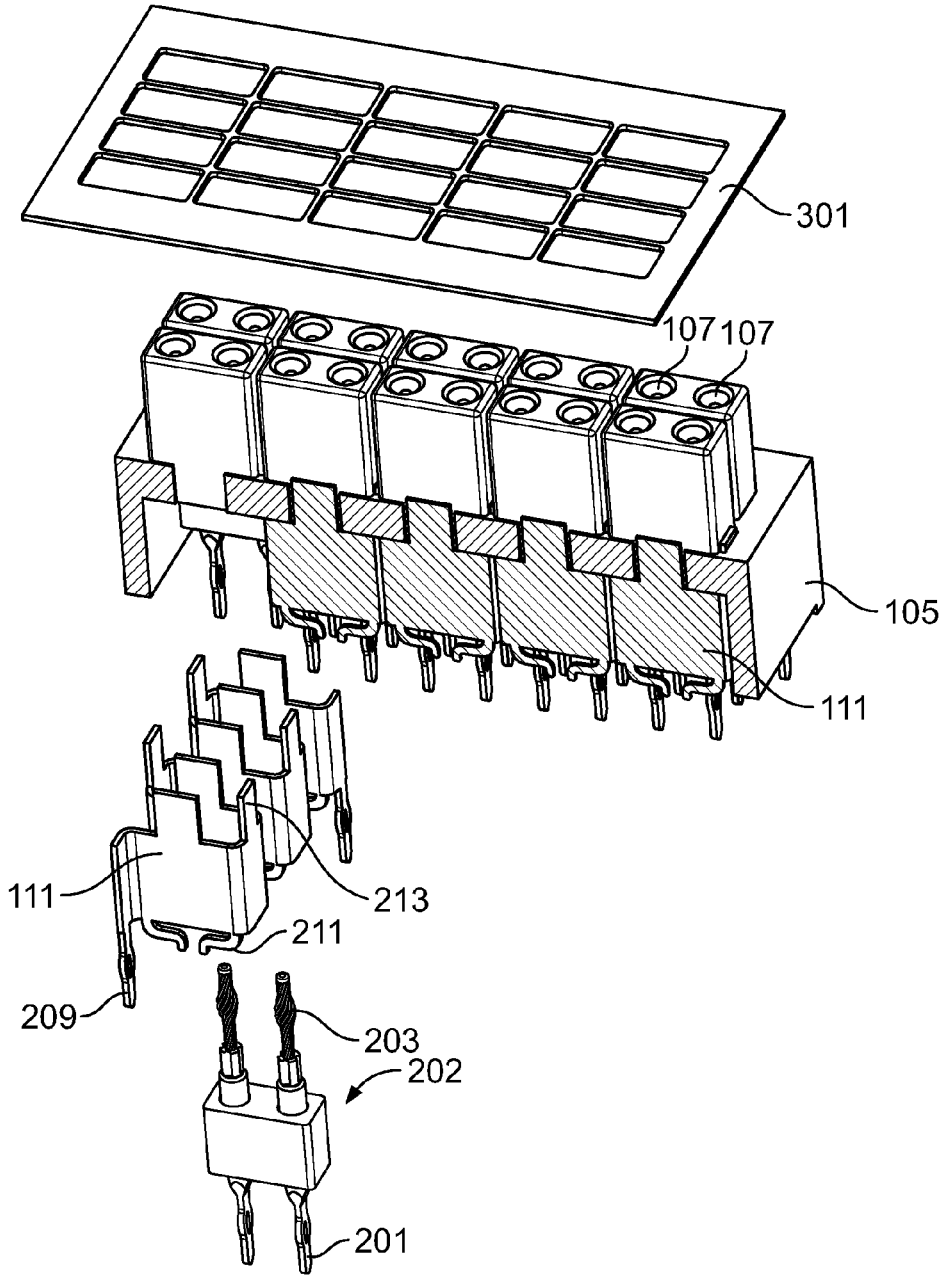
FIG. 6 shows an exploded view of a terminal module having a housing member according to an embodiment of the disclosure.
Figure 7:
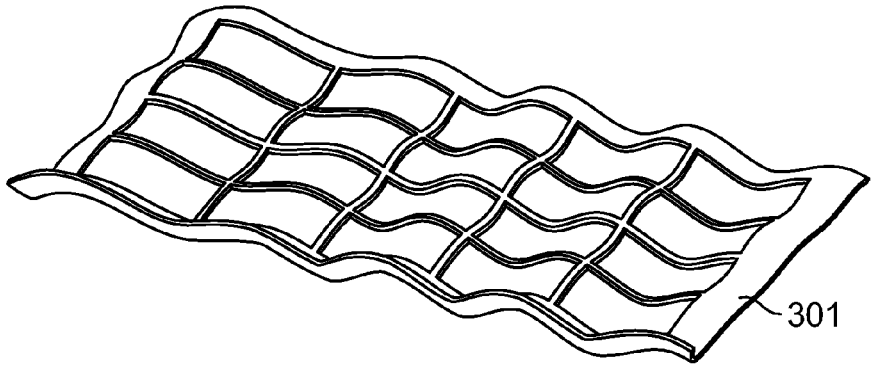
FIG. 7 shows a perspective view of a grounding member according to an embodiment of the disclosure.

FIG. 5 shows a module 101 with an electrically insulative housing member 105 engaged therewith. The housing member 105 may be engaged with a plurality of interconnection assemblies 202 having shielding members 111 disposed between adjacent contact interconnections 113 and adjacent interconnection assemblies 202. The engagement between the housing member 105 and the module 101 preferably includes a frictional engagement between the module and the housing member 105. However, adhesive, fasteners or other attachment devices and techniques may also be used. As shown in FIGS. 5-7, the housing member 105 includes a housing grounding member 301 to provide additional grounding when engaged with backplane 800. The housing grounding member 301 is preferably formed of an elastically deformable, electrically conductive material. The housing grounding member 301 is configured to be in electrical communication with the shielding members 111 when the housing member 105 is engaged with the module 101. The electrical communication between the housing grounding members 301 may be provided by wires, extensions or other electrically conductive members that pass through the body of the housing member 105 and physically contact the shielding member 111. In addition, the housing grounding members 301 reduce the mating force required to connect the module 101 and housing member 105 to the backplane 800 as compared to arrangements that include shielding having insertable portions. That is, for example, the arrangement of the shielding members 111 permits grounding without increasing the resistance required to engage connector contact 203 with backplane contact 805. The pairs of fin receiving apertures 107 form a plug 303, which is capable of engaging a corresponding cell 811 of the backplane 800 (see e.g., FIG. 13) when the module 101 and housing member 105 are engaged with the backplane 800. The housing grounding member 301 is further configured to be positioned between adjacent plugs 303. The housing grounding member 301 is preferably sufficiently elastic to receive first and/or second grounding plates 807,809 (see e.g., FIGS. 13 and 14) and provide sufficient physical contact therewith to maintain electrical communication between the first and/or second grounding plates 807,809, the housing grounding members 301 and the shielding members 111 when the module 101 and housing member 105 are engaged with the backplane 800. The housing member 105, contact receiving apertures 107 and/or the plug 303 may further include keying features or similar structures known in the art to provide alignment, keying and/or stability while components are engaged or are directed into engagement.

FIG. 6 shows an exploded view alternate embodiment of a terminal module 101 with a terminal housing member 105 according to another embodiment of the disclosure. The terminal module 101 includes the components of FIG. 5, wherein the interconnection assemblies 202 are arranged in a linear configuration. As is visible in FIG. 6, in addition to grounding contact 209 and grounding fingers 211, the grounding members 111 include grounding extensions 213 configured to pass through housing member 105 and contact housing grounding member 301 and provide electrical communication. FIG. 7 shows an alternate arrangement of housing grounding member 301, wherein the housing grounding member 301 includes a wave geometry to provide a spring-like compliance to facilitate good contact with the backplane 800 and shielding member 111.

Figure 8:
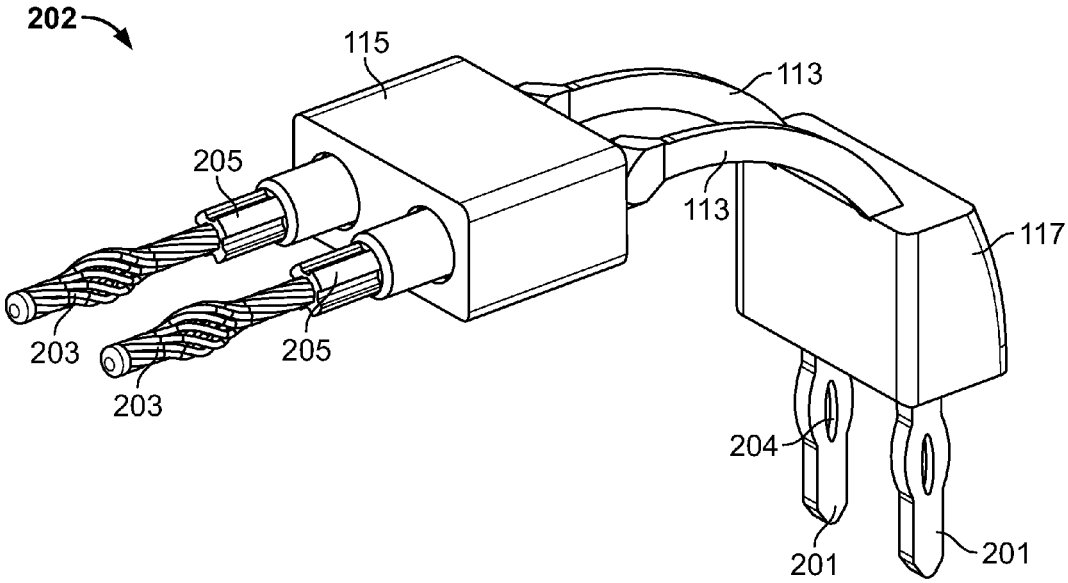
FIG. 8 shows a perspective view of an assembly of contact pairs and contact interconnections according to an embodiment of the disclosure.

FIG. 8 shows an interconnection assembly 202 according to an embodiment of the invention for placement into a module 101. As shown in FIG. 8 and described above, the interconnection assembly 202 includes a pair of first contact pairs 201, second contact pairs 203 and contact interconnections 113 in communication with the corresponding first contact pair 201 and/or second contact pair 203. The invention is not limited to the number of connector contacts 205, contacts 204 or interconnections 113 and may include any arrangement thereof. However, the length of the interconnection 113 is preferably substantially identical within the interconnection assembly 202. The module 101 may include interconnection assemblies 202 having different lengths, but the contact interconnections 113 within the interconnection assemblies 202 are preferably substantially identical.

Figure 9:
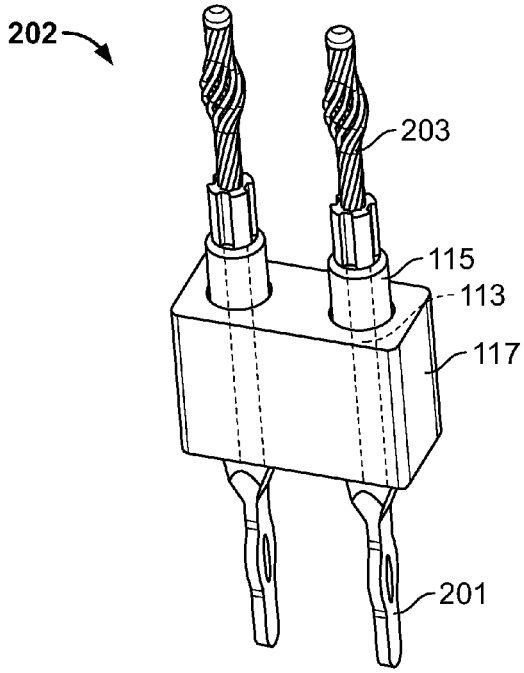
FIG. 9 shows a perspective view of an assembly of contact pairs and contact interconnections according to another embodiment of the disclosure.

FIG. 9 shows an alternate embodiment of an interconnection assembly 202 according to another embodiment of the disclosure. The interconnection assembly 202 in this embodiment includes the components of FIG. 8, wherein the interconnection assemblies 202 are arranged in a linear configuration.

Figure 10:
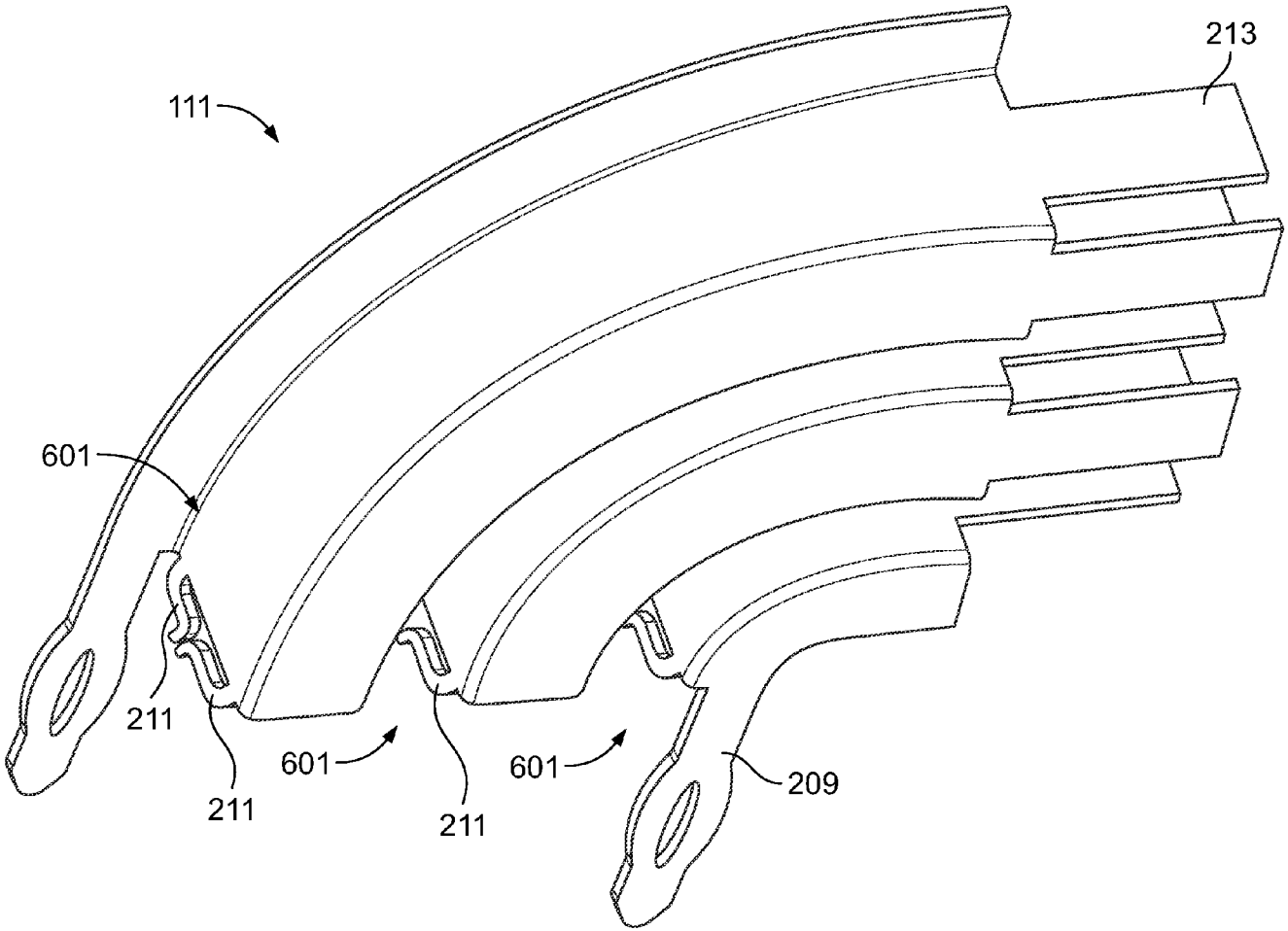
FIG. 10 shows a shielding member according to an embodiment of the disclosure.

FIG. 10 shows a shielding member 111 for use with a module 111 according to an embodiment of the present invention. As shown, the shielding member 111 is configured into an "S"-shaped geometry such that the shielding member passes along three edges in close proximity to the contact interconnections 113 (see enlarged view in FIG. 3). Specifically, the geometry forms channels 601, which permit the installation of the interconnection assemblies 202 into the shielding member 111 to form module 101. The shielding members 111 are configured such that adjacent shielding members 111 on terminal modules 101 enclose adjacent contact interconnections 113 in close proximity to four sides. Stated another way, the shielding member 111 surrounds in close proximity a majority of the contact interconnection 113, with an adjacent shielding member 111 surrounding in close proximity the remaining portion of the contact interconnection 113. It is to be understood the shielding member 111 may include geometries that are not limited to linear sides or edges and may include polygonal, semi-circular or other curved geometries wherein the edges are surfaces making up the curve. The shielding members 111 receive the spacer 117 and connection portion 115 to provide positioning of the contact interconnections 113. The interconnection assemblies 202 may be connected, engaged or detachably positioned into the shielding members. If the interconnection assemblies 202 are affixed to the shielding member 111, any connection method or technique known in the art may be utilized, including, but not limited to, frictional engagement. As discussed above, shielding member 111 includes grounding contact 209, grounding fingers 211, and grounding extensions 213 that are configured to provide grounding (i.e., electrical communication) between PCB 103 and backplane 800. Further, shielding members 111 are utilized to shield the signal contacts from EMI/RFI and may be fabricated from any material known in the art for shielding.

Figure 11:
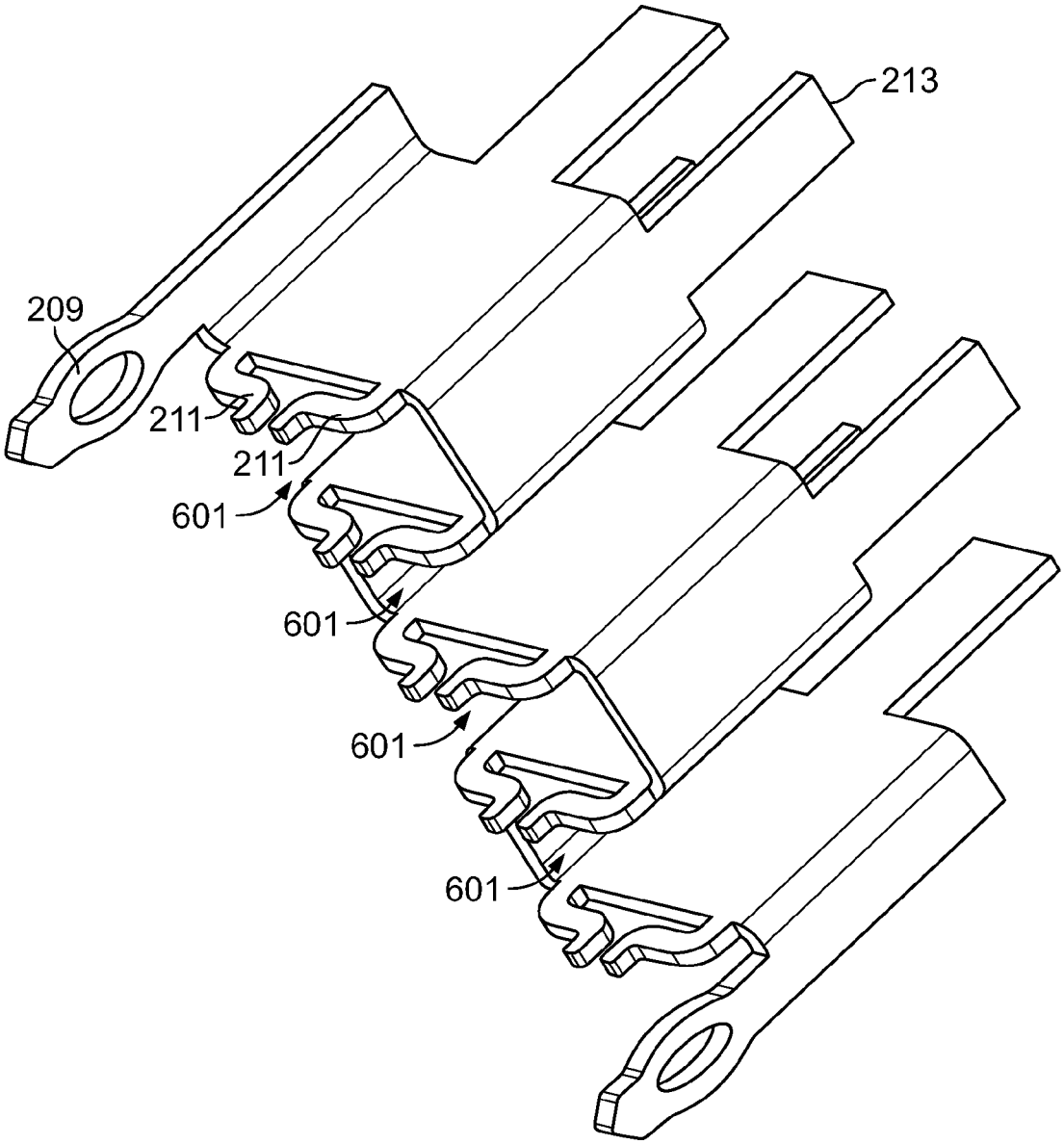
FIG. 11 shows a shielding member according to another embodiment of the disclosure.

FIG. 11 shows an alternate embodiment of a shielding member 111 according to another embodiment of the disclosure. The shielding member 111 in this embodiment includes the components of FIG. 10, wherein the interconnection assemblies 202 are arranged in a linear configuration.

Figure 12:
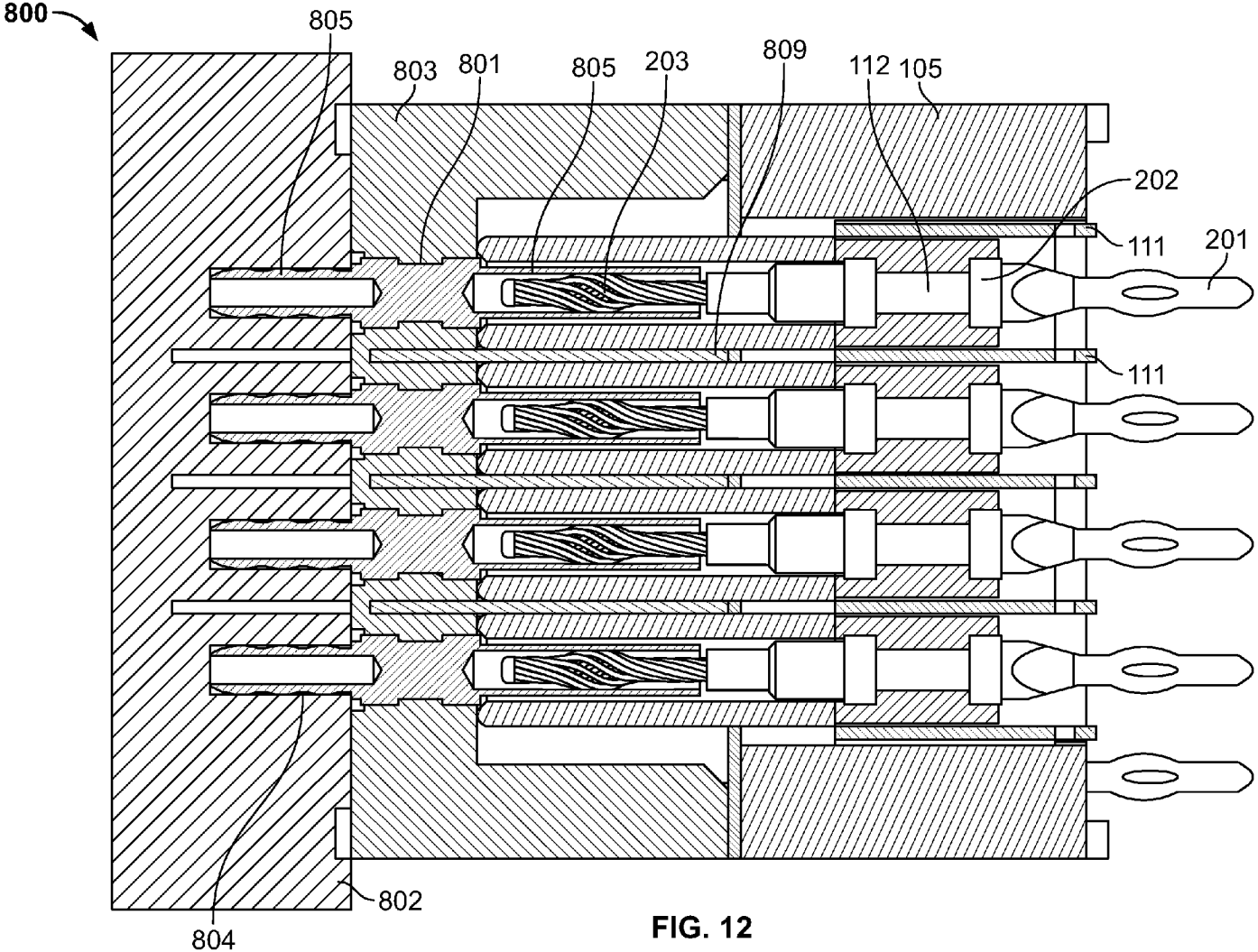
FIG. 12 shows a sectional view of a terminal module having a housing member engaged with a backplane according to an embodiment of the disclosure.

FIG. 12 shows a cross-sectional view of a terminal module 101 with a terminal housing member 105 engaged with a backplane 800. The backplane 800 is mounted on a circuit board 802 is shown as including a plurality of through hole portions 801. Circuit board 802 may be any arrangement of circuit board, including printed circuit boards, configurable to include backplane 800. Backplane 800 includes base 803 having through hole portions 801 into which backplane contacts 805 are disposed. The base 803 includes a plurality of backplane contacts 805 engaged with second contact pairs 203. Circuit board 802 includes openings 804 corresponding to the through hole portions 801 of the backplane 800. The contacts 805 may be individually unitary components or may be a plurality of components connected to each other (i.e., collective unitary construction). For example, the contacts 805 may include cylindrical geometries extending from the base 803 and a pin-like geometry extending into or through the circuit board 802. A second grounding plate 809 is arranged between engaged backplane contacts 805 and second contact pair 203.

Figure 13:
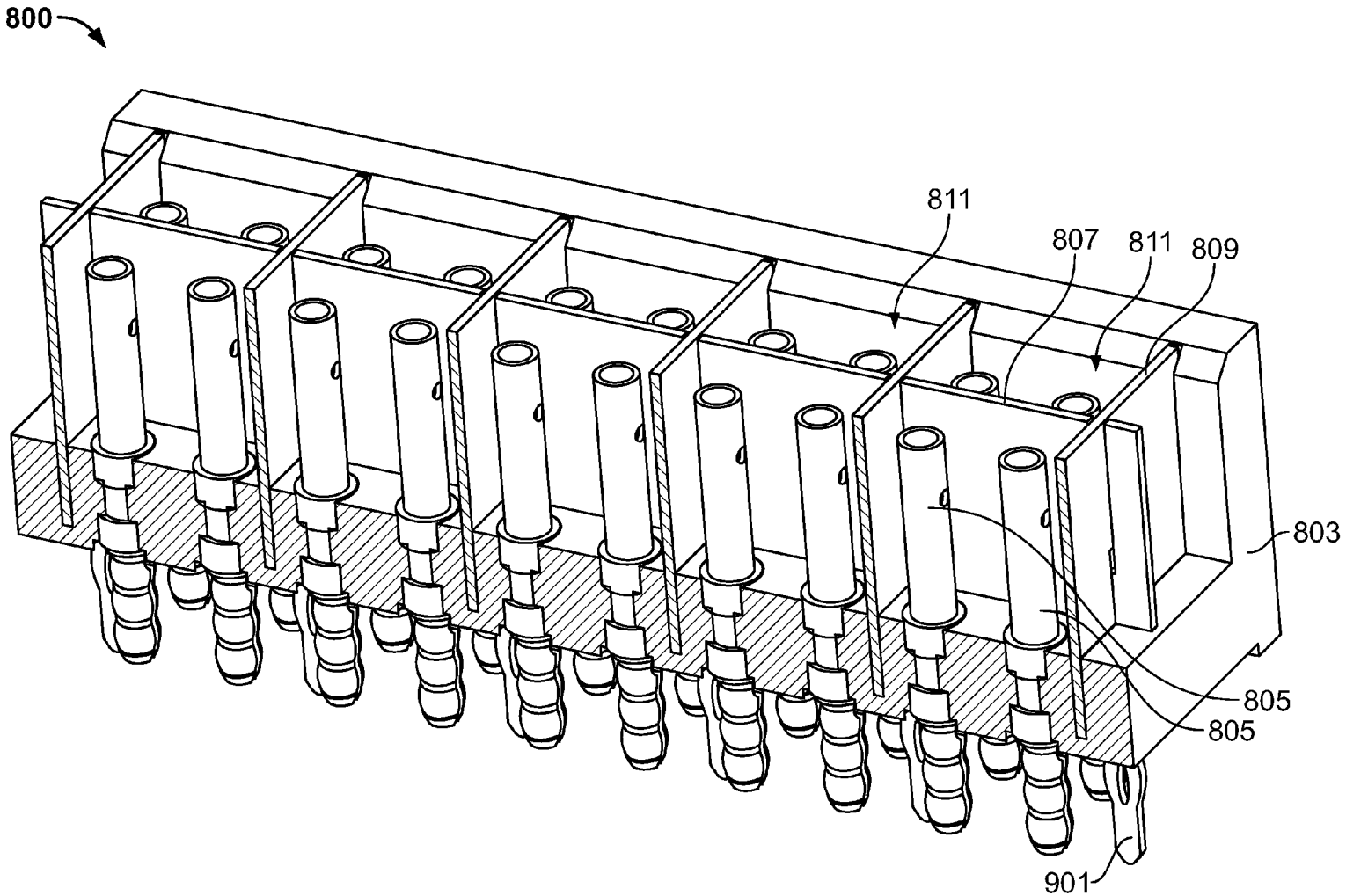
FIG. 13 shows a sectional view of a backplane according to an embodiment of the disclosure.

FIG. 13 shows a perspective section view of a backplane 800 according to an embodiment of the present disclosure. As discussed above with respect to FIG. 12, the backplane includes a base 803, through which backplane contacts 805 are mounted. The base 803 may further include keying features or similar structures known in the art to provide alignment, keying and/or stability while components are engaged or directed into engagement. In addition, a plurality of first grounding plates 807 and second grounding plates 809 are arranged and disposed to shield the signal contacts from EMI/RFI and may be fabricated from any material known in the art for providing electrical shielding. The first grounding plates 807 and second grounding plates 809 are arranged into a grid pattern forming cells 811. The first and second grounding plates 807,809 are preferably fabricated from an electrically conductive material, such as copper or other metal or alloy. The first and second grounding plates 807,809 are preferably exposed and capable of being engaged and in physical contact with the housing grounding member 301 when the system 100 is connected to backplane 800. Second grounding plate 809 includes a grounding member 901 extending in a manner that permits electrical connection to the openings 804 of circuit board 802 for the purposes of grounding. The second grounding plate 809 further includes slots 903 configured to mate slots 1003 of first grounding plate 807 (see FIG. 14) to form a grid geometry (see FIG. 15).

Figure 14:
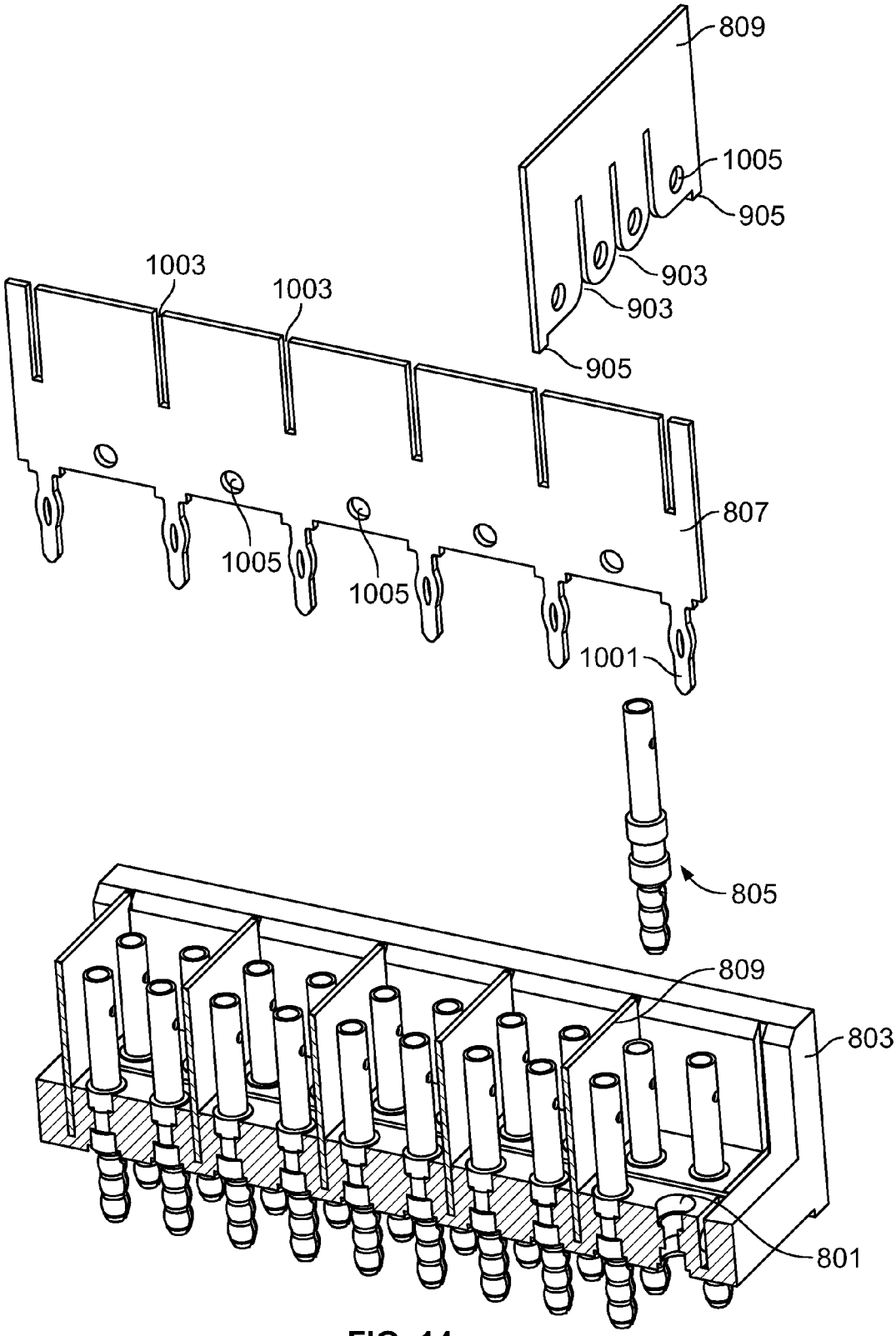
FIG. 14 shows an exploded view of a backplane according to an embodiment of the disclosure.

FIG. 14 shows an exploded view of a backplane 800 according to another embodiment of the disclosure. In this embodiment, the first grounding plate 807 includes a grounding member 1001 extending in a manner that permits electrical connection to the openings 804 of circuit board 802 for the purposes of grounding. The first grounding plate 807 further includes slots 1003 configured to mate slots 903 of second grounding plate 807 a grid geometry (see FIG. 15). The first grounding plate 807 and second grounding plate 809 further include molding apertures 1005 configured to permit flow of molding material for formation of base 803. The molding materials suitable for formation of base 803 include, but are not limited to polymeric or other insulative materials. The molding apertures 1005 allow passage of molding material during molding and provide for a more uniform distribution of material making up base 803. As shown in this embodiment, second grounding plate 809 includes grounding plate fingers 905 extending from the second grounding plate 809 and configured to contact the circuit board 802 through base 803. The present disclosure is not limited to the geometry shown and may include alternate protrusions or structures to facilitate grounding.

Figure 15:
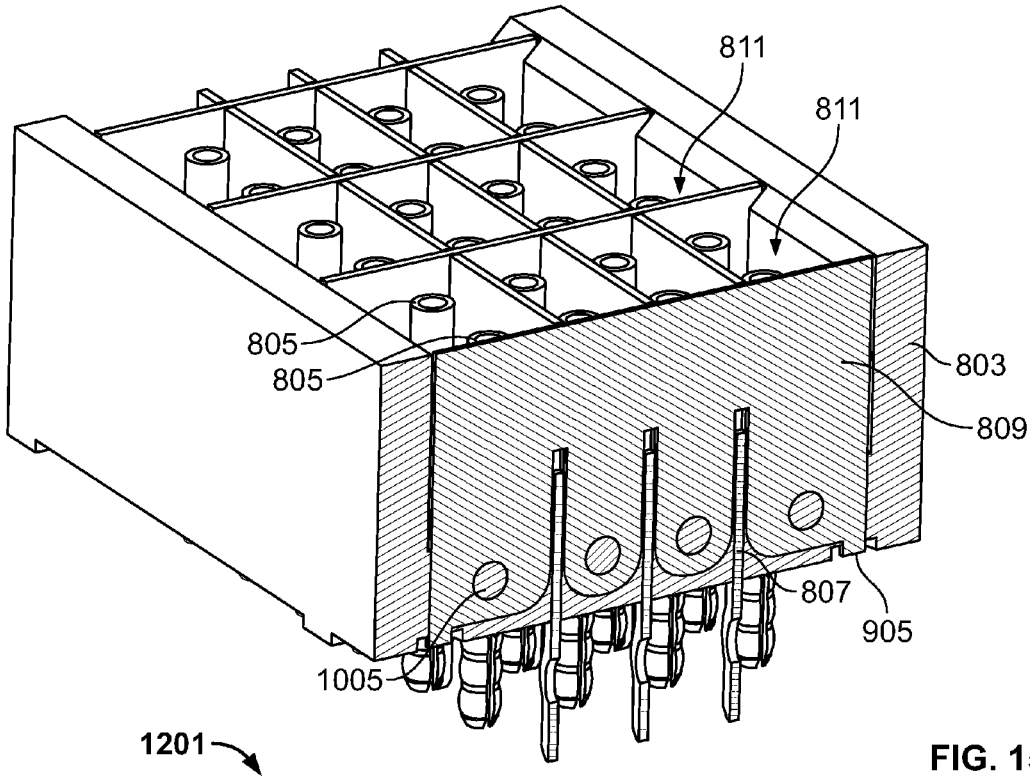
FIG. 15 shows a sectional view of a backplane according to an embodiment of the disclosure.

FIG. 15 shows an assembled grid of the first grounding plates 807 and second grounding plates 809. The assembled backplane 800 includes a grid forming a plurality of cells 811, corresponding to the pairs of backplane contacts 805. The invention is not limited to size or arrangement of grid shown in FIGS. 13-15 and may include more or less first and second grounding plates 807,809. In addition, the invention is not limited to grids disposed at perpendicular angles and other geometries and may include other angles for formation of non-rectangular grids and cells 811.

Figure 16:
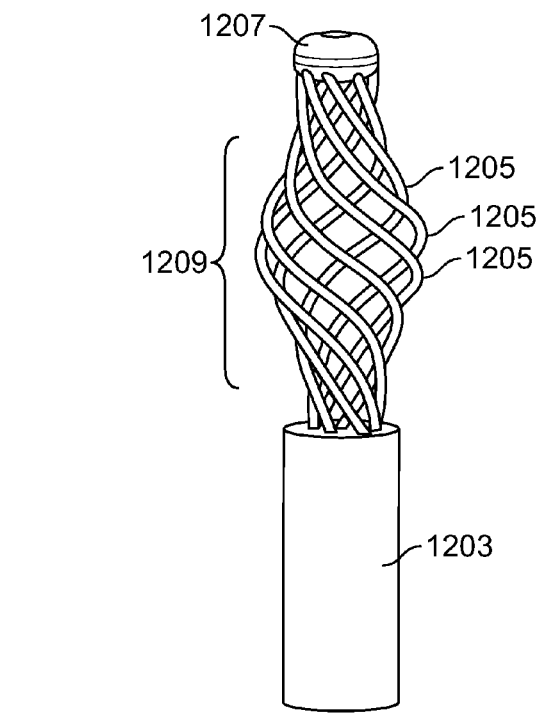
FIG. 16 shows a mesh contact member for use with a contact pair according to an embodiment of the invention.

FIG. 16 shows a mesh contact element 1201 according to an embodiment of the present disclosure. One embodiment of the invention includes a second contact pair 203 (e.g., FIG. 3) having a mesh contact element 1201 or having a connector contact 205 (e.g., FIG. 3) configured to receive a mesh contact element 1201. The mesh contact element 1201 has a mesh bulb or bulbous portion 1209 formed from electrically conductive material. The mesh contact element 1201 includes a woven or non-woven mesh of conductive wire leads 1205. In this embodiment, the second contact pair 203 may be formed integrally with the contact interconnection 113 and first contact pair 201 or may be connected to the contact interconnection 113 via any known connection method. The mesh contact element 1201 includes a base 1203 that may be configured integrally with the contact interconnection 113 and first contact pair 201 or connectable to the contact interconnection 113. Wire leads 1205 extend from the base 1203 and form a bulbous geometry. The wire leads 1205 are fabricated from an electrically conductive wire material, which is bent or oriented into a woven or non-woven structure. The wire leads 1205 terminate at a tip 1207, which provides a reduced diameter and termination/consolidation of the wire leads 1205 suitable for insertion into a socket or similar contact. The bulbous portion 1209 of the mesh contact element 1201 is elastically deformable and provides a plurality of contact points between the wire leads 1205 and the socket or contact. The deformation may be from bending or deflecting of the wire leads 1205 or deflection of the bulbous portion 1209 due to the weave or pattern of the wire leads 1205. When engaged with a connector contact 205, contact with bulbous portion 1209 is substantially uniformly distributed along the periphery of the engaged socket or contact, providing resistance to vibration, jarring, movement or other environmental conditions that may occur, particularly when utilized in vehicles operating in rugged and/or extreme environments. In addition, the mesh contact element 1201 resists or prevents unintentional disengagement from the connector contacts 205 even during exposure to rugged or extreme environments.

To connect the backplane 800 (see FIG. 13) to the connector system 100, the backplane 800 and the connector system 100 are directed toward each other, wherein the contacts 805 are inserted into the contact receiving apertures 107 (see FIG. 2), wherein the contacts 805 engage and retain physical contact and electrical connectivity within connector contact 205.

The present disclosure is not limited to the arrangement of connector system 100 and backplane 800 shown and described above. The connector system 100 and backplane 800 may be arranged perpendicularly, in parallel or at any angle or orientation to each other. The modules 101 may be fabricated such that the first and second contact pairs 201, 203 are at varying angles to each other to provide connectivity at corresponding angles between circuit boards.

Figures 17, 18:
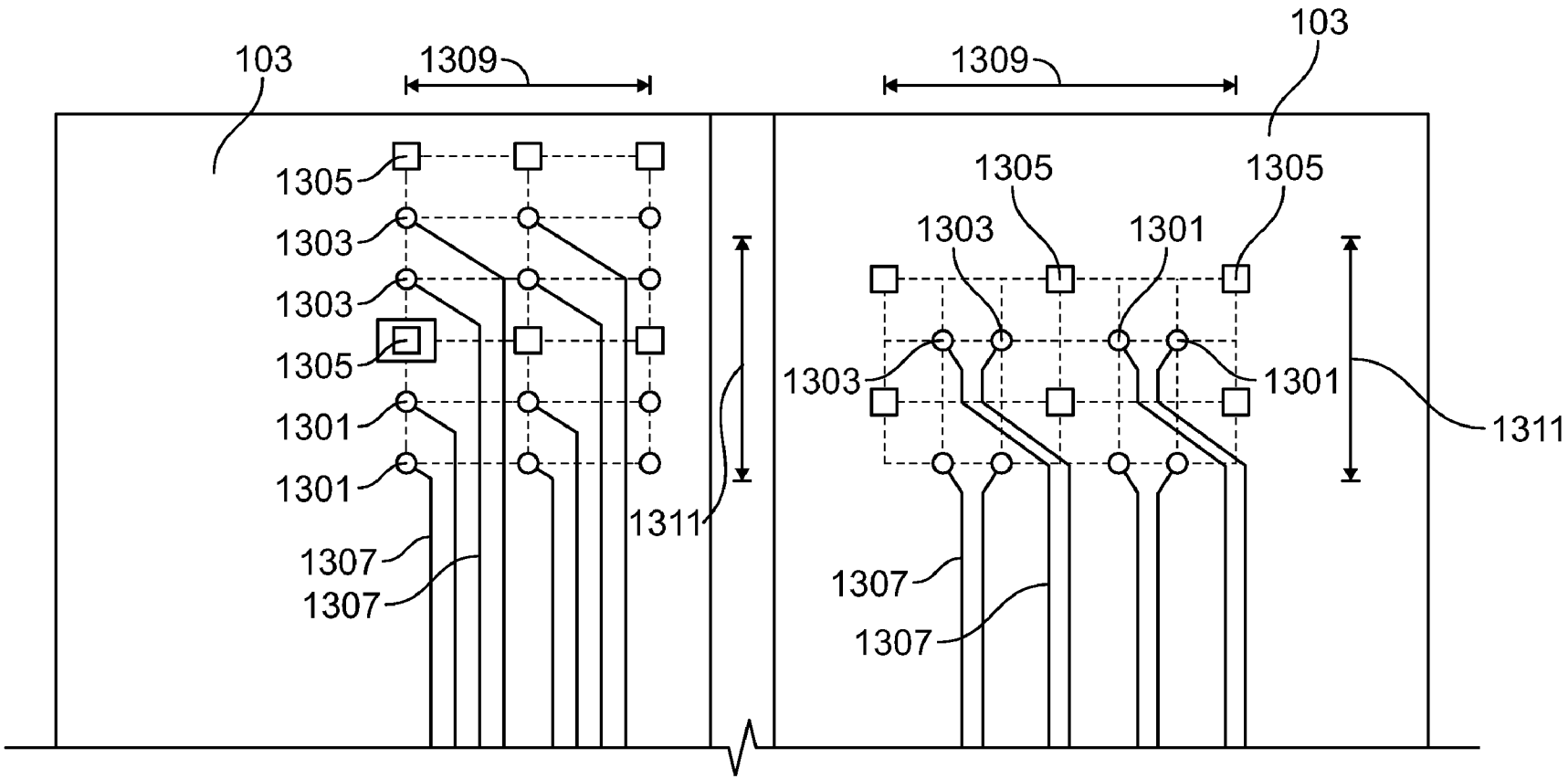
FIG. 17 shows a schematic contact arrangement according to a known backplane assembly.
FIG. 18 shows a schematic contact arrangement according to an embodiment of the present invention.

FIG. 17 shows a schematic arrangement contact pattern on a PCB 103 according to a known contact pattern arrangement. The arrangement includes a contact pair 1301 made up of two contacts 1303. The contact pairs 1301 are separated by a grounding contact 1305. The separation of the contact pairs 1301 is such that the cross-talk between contact pairs is reduced or eliminated. In addition, wiring routes 1307 are shown. Contact pairs 1301 are arranged parallel to a first dimension 1309 and perpendicular to a second dimension 1311. The second dimension 1311 corresponds to a longer dimension (e.g., length) of PCB 103 and first dimension 1309 preferably corresponds to a shorter dimension (e.g., width) of PCB 103. The known arrangement undesirably requires additional length along the first dimension when additional wiring is required, which may introduce skew between the contact pairs. Additional length along the first dimension may require reconfiguration of the circuit boards and/or the circuitry already present in a system.

FIG. 18 shows a schematic arrangement contact pattern on a PCB 103 according to an embodiment of the present invention. Unlike the arrangement shown in FIG. 17, the contact pairs 1301 are arranged parallel to the second dimension 1311 and perpendicular to the first dimension 1309. The arrangement provided by the present disclosure permits lengthening of the backplane when additional wiring or connections are required decreasing the complexity modifying the PCB 103 and providing the ability to use existing connector and system architecture to extend the wiring along the second dimension.

Figure 19:
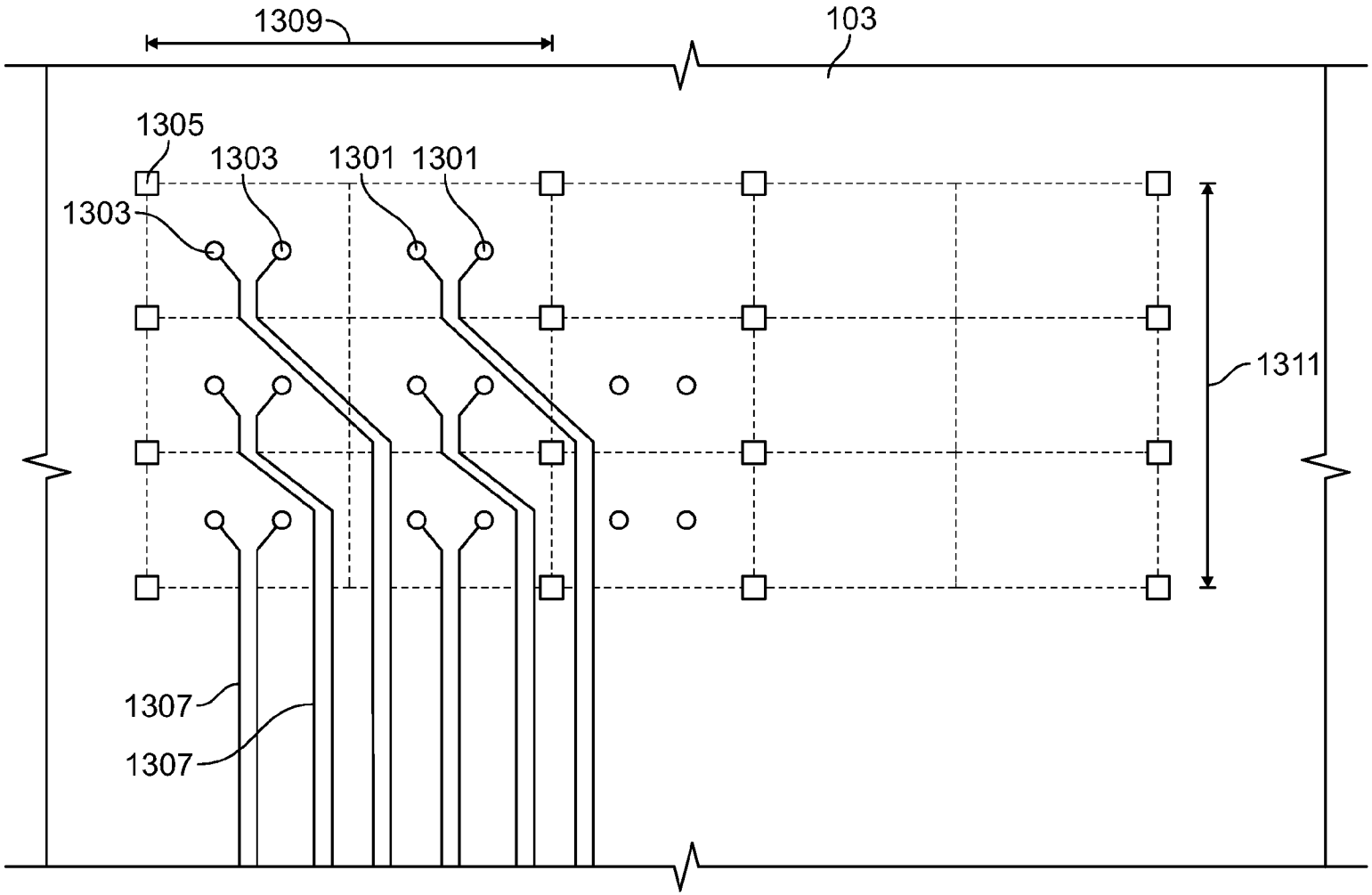
FIG. 19 shows a schematic contact arrangement according to another embodiment of the present invention.

FIG. 19 shows a schematic arrangement contact pattern on a PCB 103 according to another embodiment of the present invention. In this embodiment, three contact pairs are arranged along the second dimension, wherein the wiring 1307 routes are easily managed and do not interfere with one another. Other configurations may be provided with the arrangement of contact pairs 1301.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A terminal module for assembly into a high-speed electrical connector, the module comprising:

a first contact pair comprising a pair of contacts, each contact being capable of receiving a corresponding contact disposed on a backplane;

a second contact pair in electrical communication with the first contact pair via a corresponding pair of contact interconnections, the contact interconnections having a substantially identical length and being arranged within parallel planes; and a shielding member arranged in an S-shaped geometry so that the shielding member is disposed in close proximity to three edges of the contact interconnections to provide shielding.

2. The module of claim 1, wherein the first contact pair and the second contact pair are arranged perpendicularly to each other.

3. The module of claim 1, wherein the shielding member includes at least one grounding finger.

4. The module of claim 1, wherein the shielding member includes at least one grounding contact.

5. The module of claim 1, wherein each contact of the second contact pair comprises a socket.

6. The module of claim 1, wherein each contact of the second contact pair is configured to receive a corresponding contact selected from the group consisting of mesh contact member, a bristle, a compliant pin, a non-compliant pin and combinations thereof.

7. The module of claim 1, wherein each contact of the first contact pair comprises a pin.

8. The module of claim 1, wherein each contact of the first contact pair is selected from the group consisting of mesh contact member, a bristle, a compliant pin, a non-compliant pin and combinations thereof.

9. The module of claim 1 further comprising a housing member arranged and disposed to receive the contacts of the second contact pair via contact receiving apertures.

10. The module of claim 9, wherein the housing member further comprises a housing shield configured to provide electrical communication between one or more grounding plates of a backplane and the shielding member.

11. The module of claim 10, wherein the housing shield is an elastically deformable electrically conductive member extending through the housing and in sufficient physical contact with the shielding member to provide electrical communication therebetween; and wherein no additional mating force is required to the electrical communication.

12. The module of claim 1, wherein the module comprises a plurality of sets of first contact pairs, second contact pairs and contact interconnections.

13. The module of claim 1, wherein the first contact pair is configured to engage a printed circuit board in a configuration permitting parallel pair arrangements oriented along the length of the printed circuit board.

14. A backplane assembly for a high-speed electrical connector, the assembly comprising:

a first grounding plate having an opening configured to permit flow of electrically insulative material during formation of an insulative body;

the electrically insulative body in contact with at least a portion of the first grounding plate; and wherein the first grounding plate comprises a contact arranged and disposed to electrically connect to a circuit board.

15. The assembly of claim 14, wherein a second grounding plate is disposed at a substantially perpendicular angle to the first grounding plate to form a grid arrangement forming a plurality of cells, each cell being configured to receive a contact pair, wherein one or both of the first grounding plate and the second grounding plate comprises a contact arranged and disposed to electrically connect to a circuit board.

16. The assembly of claim 15, wherein the cells are configured with the first grounding plates and second grounding plates oriented along at least four edges of the cell to provide shielding.

17. The assembly of claim 15, wherein one of both of the first grounding plate and the second grounding plate is arranged to be in electrical communication with a shielding member of a terminal module when the backplane assembly is engaged with the terminal module.

18. The assembly of claim 15, wherein the cells are arranged with openings to receive a contact, the openings within the cells being oriented parallel to a dimension along the length of the circuit board.

19. The assembly of claim 15, wherein the cells further include the contacts, the contacts being arranged in pairs and being oriented parallel to a dimension along the length of the circuit board.

20. A high-speed electrical connector system comprising:

a module engaged with a housing, the module comprising:

a first contact pair comprising a pair of contacts, each contact being capable of receiving a contact disposed on a backplane;

a second contact pair in electrical communication with the first contact pair via a corresponding pair of contact interconnections, the contact interconnections having a substantially identical length and being arranged within parallel planes; and a shielding member arranged and disposed in close proximity to a plurality of edges of one or more of the first contact pair, the second contact pair and the contact interconnections to provide shielding; and the housing member being arranged and disposed to receive the contacts via contact receiving apertures, the housing member further being engaged with the first contact pair to receive the contacts into the contacts of the first contact pair, the housing member having an elastically deformable grounding member to provide additional shielding when the grounding member engages a backplane; and the backplane engaged with the housing member and the module, the backplane comprising:

a first grounding plate;

a second grounding plate disposed at a substantially perpendicular angle to the first grounding plate to form a grid arrangement forming a plurality of cells, each cell being configured with a pair of the contacts;

an electrically insulative body in contact with at least a portion of the first grounding plate and the second grounding plate; and wherein one or both of the first grounding plate and the second grounding plate comprises a contact arranged and disposed to electrically connect to a circuit board.

* * * * *